US011819911B2

(12) United States Patent
Gerner et al.

(10) Patent No.: US 11,819,911 B2
(45) Date of Patent: Nov. 21, 2023

(54) DIE-CASTING MACHINE AND OPERATING METHOD

(71) Applicant: Oskar Frech GmbH + Co. KG, Schorndorf (DE)

(72) Inventors: Daniel Gerner, Moegglingen (DE); Andreas Sydlo, Urbach (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 60 days.

(21) Appl. No.: 17/352,935

(22) Filed: Jun. 21, 2021

(65) Prior Publication Data

US 2021/0394260 A1 Dec. 23, 2021

(30) Foreign Application Priority Data

Jun. 22, 2020 (DE) ..... 10 2020 207 704.5
Nov. 26, 2020 (EP) ..... 20210020

(51) Int. Cl.
*B22D 17/32* (2006.01)
*B22D 17/04* (2006.01)
*B22D 17/20* (2006.01)

(52) U.S. Cl.
CPC ..... *B22D 17/32* (2013.01); *B22D 17/04* (2013.01); *B22D 17/203* (2013.01)

(58) Field of Classification Search
CPC ..... B22D 17/04; B22D 17/203
See application file for complete search history.

(56) References Cited

U.S. PATENT DOCUMENTS

| | | | |
|---|---|---|---|
| 5,092,499 | A | 3/1992 | Sodderland |
| 5,636,680 | A | 6/1997 | Mogensen et al. |
| 6,062,294 | A | 5/2000 | Yukisawa et al. |
| 2003/0029596 | A1 | 2/2003 | Fink |
| 2012/0273530 | A1 | 11/2012 | Erhard et al. |

(Continued)

FOREIGN PATENT DOCUMENTS

| | | | |
|---|---|---|---|
| DE | 678949 | C | 7/1939 |
| DE | 3248423 | A1 | 6/1984 |
| DE | 195 23 819 | A1 | 1/1996 |

(Continued)

*Primary Examiner* — Kevin E Yoon
*Assistant Examiner* — Jacky Yuen
(74) *Attorney, Agent, or Firm* — Crowell & Moring LLP

(57) ABSTRACT

A die-casting machine has a casting mould, a casting chamber, a casting piston arranged in an axially movable manner in the casting chamber, a melt inlet channel which leads into the casting chamber, a shut-off valve in the melt inlet channel, a melt outlet channel which leads from the casting chamber to the casting mould, and a control unit for controlling the casting piston. The control unit and the shut-off valve are configured, after completing a filling phase in a subsequent refilling phase firstly to bring the shut-off valve into an open position and to control the casting piston to move back into the casting start position, in order to supply the casting chamber with melt material via the melt inlet channel, and to control the shut-off valve into its closed position again before the casting piston has reached its casting start position by virtue of its return movement, and to control the casting piston to back-suction melt material in the melt outlet channel by virtue of the further return movement of the casting piston.

11 Claims, 8 Drawing Sheets

(56) References Cited

U.S. PATENT DOCUMENTS

2014/0042193 A1 2/2014 Aspacher et al.

FOREIGN PATENT DOCUMENTS

| | | | | | |
|---|---|---|---|---|---|
| DE | 198 07 568 | A1 | | 8/1998 | |
| DE | 20 2009 004 299 | U1 | | 7/2009 | |
| DE | 10 2009 057 197 | B3 | | 5/2011 | |
| DE | 10 2011 017 610 | B3 | | 6/2012 | |
| DE | 10 2014 018 796 | A1 | | 6/2016 | |
| EP | 0114934 | A1 | * | 10/1983 | |
| EP | 0 576 406 | B1 | | 9/1997 | |
| EP | 1 284 168 | B1 | | 12/2005 | |
| GB | 467800 | | | 6/1937 | |
| JP | 2011-110566 | A | | 6/2011 | |
| WO | WO-2014091532 | A1 | * | 6/2014 | ..... B22D 17/04 |

* cited by examiner

DIE-CASTING MACHINE AND OPERATING METHOD

CROSS REFERENCE TO RELATED APPLICATIONS

This application claims priority under 35 U.S.C. § 119 from German Patent Application No. 102020207704.5, filed Jun. 22, 2020, and European Patent Application No. 20210020.2, filed Nov. 26, 2020, the entire disclosures of which are herein expressly incorporated by reference.

BACKGROUND AND SUMMARY OF THE INVENTION

The invention relates to a die-casting machine having a casting mould, a casting chamber, a casting piston arranged in an axially movable manner in the casting chamber, a melt inlet channel which leads into the casting chamber, a shut-off valve in the melt inlet channel, a melt outlet channel which leads from the casting chamber to the casting mould, and a control unit for controlling the casting piston. The invention also relates to a method for operating such a die-casting machine, in which method, for carrying out a respective casting process, in a mould-filling phase, with the shut-off valve closed, the casting piston in the casting chamber is advanced from a casting start position to a filling end position and, as a result, melt material is pressed into the casting mould via the melt outlet channel and, in a subsequent refilling phase, the casting piston is moved back into the casting start position and, as a result, with the shut-off valve open, melt material is fed back to the casting chamber via the melt inlet channel.

Die-casting machines of this type, of the generic type and of similar types and associated operating methods are generally used for casting a specific component, also referred to as cast part, in the respective casting process or casting cycle. The present die-casting machine, also referred to in short as machine below, and the present operating method are suitable in particular for metal die-casting, e.g. for casting liquid or partially liquid metal melts, such as zinc, lead, aluminium, magnesium, titanium, steel, copper, and alloys of these metals. The die-casting machine may be in particular a hot-chamber die-casting machine. In this implementation, the casting chamber is formed in a casting container which is immersed in a melt bath kept ready by a melt container.

In the mould-filling phase of the casting process, the advancement of the casting piston presses melt material, located in the casting chamber, under pressure out of the casting chamber into a mould cavity formed by the casting mould via the melt outlet channel, in order to form a corresponding cast part. In this respect, the casting mould usually contains a fixed and a moveable mould half, which between them form the mould cavity, also referred to as mould hollow space or, in a manner synonymous with this casting mould which is formed, mould for short. In typical implementations, the melt outlet channel comprises a riser-tube region of a casting container, which contains the casting chamber, on the inlet side and a mouthpiece body, which is attached to the casting container, on the outlet side, i.e. after it leaves the casting chamber, the melt material arrives at a melt inlet in the region directly in front of the mould cavity, in which what is known as a gating cone is typically located, via the riser-tube region and the mouthpiece body.

In the refilling phase, the casting piston is moved back again from its filling end position to its initial position, i.e. casting start position, and the return movement of the casting piston refills the casting chamber with melt material via the melt inlet channel. The refilling phase can therefore also be referred to as the piston return phase.

In the case of a corresponding machine type, as is suitable in particular for the present die-casting machine, the melt outlet channel leads out of the casting chamber separately from the melt inlet channel, i.e. melt inlet channel and melt outlet channel form two separate guide channels for the melt material with a casting-chamber inlet, at which the melt inlet channel opens out into the casting chamber, and a separate casting-chamber outlet, at which the melt outlet channel opens out of the casting chamber. This configuration facilitates independent control of the melt flows in the melt inlet channel and in the melt outlet channel, the melt flow in the melt inlet channel specifically being able to be controlled by the shut-off valve located there.

Depending on the system configuration, it is possible to use, as shut-off valve, a non-return valve which is actuated purely by melt pressure or an actively activatable shut-off valve. The latter is referred to in the present case as shut-off control valve and is controlled by the control unit. In these die-casting machines of the generic type and associated operating methods, the shut-off control valve is usually kept closed during the entire mould-filling phase and kept open during the entire refilling phase. In comparison with a mere non-return valve, as an actively controllable or activatable shut-off valve it offers the option of influencing or regulating the melt throughflow in the melt inlet channel as required, this also independently of the melt pressure ratios in the casting chamber and/or in the melt inlet channel.

Depending on the system configuration, the control unit comprises a single control device in which all control functionalities of the die-casting machine are integrated, or a plurality of single control devices, each of which controls and/or regulates specific machine components and which preferably have a communication link with one another. In this case, as is customary, the control unit may be configured at least partially in hardware and/or at least partially as software. In the present case, the control unit controls in particular the casting piston, more precisely the movement thereof, and optionally one or more further machine components, such as in particular the shut-off control valve, if the shut-off valve is implemented by such a shut-off control valve.

The patent publication EP 0 576 406 B1 discloses such a procedure for a system which has a casting piston of the displacement type, as is known as an alternative to a casting piston of the spool type, and has a shut-off control valve arranged directly at an opening of the melt inlet channel into the casting chamber. In the case of the spool type, the outer dimension of the casting piston corresponds to the inner dimension of the casting chamber, the piston being sealed with respect to the casting chamber wall. Consequently, in this case, when it advances the casting piston pushes the melt material in the casting chamber completely forward and in the process exerts the pressure on the melt material required to press it into the mould cavity. In the case of the displacement type, the outer dimension of the casting piston is suitably smaller than the inner dimension of the casting chamber, and therefore the casting piston dips into the melt material of the casting chamber when it advances. The action of pressure on the melt material is brought about in this case by the displacement effect of the volume of the casting piston that dips into the melt material.

The laid-open publication DE 32 48 423 A1 likewise discloses a die-casting machine of the generic type and an associated operating method, in said document a casting piston with a forward piston of the displacement type and a pressurized gas which additionally can be fed to the casting chamber being used and the shut-off control valve being located in a casting container, containing the casting chamber, at a respective distance in terms of flow upstream of the casting chamber and downstream of an inlet into the casting container in the melt inlet channel. During the mould-filling phase, the shut-off control valve is kept closed. During the refilling phase, the shut-off control valve is opened and conducts a certain amount of pressurized gas into the casting chamber, in order, before the shut-off control valve is opened, to avoid the formation of a vacuum in the casting chamber and to avoid the spraying of melt which has been pulled in as a result onto the casting-piston part to the rear of the forward piston and to bias the gas pressure in the casting chamber by a certain amount above atmospheric pressure. After a required amount of melt has been fed during the refilling phase, the shut-off control valve is closed again.

In die casting, for economic reasons a cycle time, i.e. duration of a respective casting process, which is as short as possible is sought and for reasons relating to the quality of the cast part an air fraction in the cast part which is as low as possible, i.e. a minimum air porosity of the cast part, is sought. In order to account in particular for the latter aspect, the patent publication EP 1 284 168 B1 proposes, at the beginning of the mould-filling phase and/or before the actual mould-filling phase, in a pre-filling phase to advance the casting piston already when the mould is still open far enough that the melt material fills the riser-channel region and the mouthpiece body region, before then the mould is closed and the casting piston is advanced again to carry out the actual mould-filling phase. In said document, the casting piston is of the spool type and itself functions as a shut-off member in that it opens up the casting chamber inlet by performing a return movement behind it during the refilling phase and shuts off said casting chamber inlet by advancing beyond it during the mould-filling phase.

Further aspects generally to be considered in the case of die-casting machines of the present type are, inter alia, the minimization of wear effects of the oppositely situated walls of casting piston and casting chamber as a result of the stroke movement of the casting piston in the casting chamber, in particular if it is of the spool type, and the prevention of an undesired formation of a melt droplet in the region of the gating cone, which conventionally forms the inlet-side interface of a mould-side melt channel structure, which opens out on the outlet side with a gate into the mould cavity, for the purpose of coupling to the mouthpiece body.

The invention is based on the technical problem of providing a die-casting machine and an associated operating method of the type mentioned at the outset, which offer advantages over the abovementioned prior art in particular in terms of achieving relatively short casting cycle times and/or a relatively low air porosity in the cast part and/or in terms of a relatively low tendency to wear of casting piston and casting chamber and/or avoiding the formation of a melt droplet in the gating-cone region.

The invention solves this problem by providing a die-casting machine operating method and a die-casting machine in accordance with the independent claims. Advantageous refinements of the invention are specified in the dependent claims.

By the operating method according to the invention, for carrying out a respective casting process, in a mould-filling phase, with the shut-off valve closed, the casting piston in the casting chamber is advanced from a casting start position to a filling end position and, as a result, melt material is pressed into the casting mould via the melt outlet channel and, in a subsequent refilling phase, the casting piston is moved back into the casting start position and, as a result, with the shut-off valve open, melt material is fed back to the casting chamber via the melt inlet channel According to one aspect of the operating method according to the invention, in the refilling phase of the casting process, the previously open shut-off valve is closed before the casting piston has reached its casting start position by virtue of its return movement, and as a result of the further return movement of the casting piston melt material in the melt outlet channel is back-suctioned, i.e. is back-suctioned from the melt outlet channel partially into the casting chamber. The closing of the shut-off valve may be performed actively by the control unit in the case of a shut-off control valve and e.g. by a preload element which preloads the valve in its closed position, such as a preload spring, in the case of a non-return valve. Consequently, in this operating method, in an initial stage of the refilling phase the shut-off valve is initially opened when the casting piston moves back, with the result that the casting chamber is refilled with melt material via the melt inlet channel, while in the remaining stage of the refilling phase the shut-off valve is closed, with the result that the further movement back of the casting piston makes it possible to back-suction melt material in the melt outlet channel. For the purpose of opening, when implemented as a shut-off control valve the shut-off valve is controlled into its open position by the assigned control unit, and when implemented as a non-return valve the shut-off valve is controlled by the melt negative pressure in the casting chamber.

This procedure according to the invention advantageously combines the required refilling of the casting chamber with melt material via the melt inlet channel with a partial back-suctioning of melt material in the melt outlet channel. In the process, after the filling phase the non-solidified melt material in the melt outlet channel is preferably not completely back-suctioned to a melt fill level which is present in the casting chamber or an upstream melt bath, but rather may remain in the melt outlet channel up to a front region thereof to an extent which can be set and/or predefined by correspondingly selecting the point in time at which the shut-off valve is closed and/or the associated position of the casting piston, and therefore in a subsequent casting process does not first have to be advanced to this fill level in the melt outlet channel.

This procedure according to the invention offers a number of advantages on account of these properties. In this way, the cycle time for the casting processes which follow one another can be shortened. Similarly, the movement stroke of the casting piston in the casting chamber can be reduced, as a result of which associated wear effects can be minimized. The wear at wear-afflicted parts of the casting chamber and the casting piston, including customary piston rings, is also thus considerably reduced by this procedure according to the invention, e.g. in comparison with conventional systems in which the casting piston functions as a shut-off member for the melt inlet channel, because the negative pressure which occurs during the return movement of the casting piston in the casting chamber can be kept distinctly lower, if needed, by suitably controlling and/or switching over the shut-off valve. Since the melt outlet channel can remain predominantly filled with melt material between casting processes which follow one another, at the beginning of the respective casting process air is present in the front portion of the melt outlet channel to a correspondingly small extent, as a result of which the air porosity of the cast part produced can be significantly reduced, which accordingly can considerably improve the quality of the cast part produced.

The back-suctioning of non-solidified melt material in the melt outlet channel makes it possible to a controllable and/or monitored extent, i.e. in a controllable and/or predefinable amount, to very advantageously prevent an undesired formation of a melt droplet in the region of the gating cone of the die-casting machine and/or the moulding tool thereof, i.e. at the sprue or at the transition or exit of the melt outlet channel or of a mouthpiece body, forming the outlet-side portion of said melt outlet channel, to a subsequent mouthpiece nozzle or mouthpiece tip, by back-suctioning the melt material away from the outlet region there of the melt outlet channel to a greater or lesser extent into the melt outlet channel. The extent of back-suctioning may be suitably set or predefined, i.e. selected, depending on requirements and the conditions of the die-casting machine, expediently in such a way that on the one hand said formation of a melt droplet is reliably prevented and on the other hand the melt material still remains relatively far in front, i.e. preferably in a front region or region which lies far in front, in the melt outlet channel.

In advantageous implementations, in this respect the melt material is back-suctioned far enough that it on the one hand remains, i.e. is available, in the melt outlet channel as far as a front region, or region which lies relatively far in front, of said melt outlet channel, but on the other hand is located behind the melt outlet channel at a certain, relatively low distance of e.g. approx. 5 mm to 100 mm from the gating cone or exit of the melt outlet channel at which otherwise the melt droplet would form, in particular at a distance from this exit or from a melting-away point which is located shortly behind this exit depending on the existing system and at which melt that is still relatively liquid breaks off from the already-solidified or partially solidified melt ahead of it in the gating cone or in the mould of e.g. between approx. 10 mm and approx. 50 mm, preferably e.g. between approx. 30 mm and approx. 40 mm, depending on requirements, the viscosity of the melt material and/or the system configuration of the machine. In corresponding, typical embodiments of the die-casting machine, the back-suctioning stroke of the casting piston required for this purpose from the position of the casting piston at which the shut-off valve is closed to the casting start position is in the range of one millimeter to a few millimeters, e.g. between approx. 2 mm and 20 mm.

The back-suctioning moreover has the advantage that a travel of the stroke of the casting piston that in a first stage of the mould-filling phase can be used in the subsequent casting process to accelerate the casting piston before the casting piston begins to press the melt material into the mould is correspondingly obtained as a result. This can be favourable primarily also in the case of moulds with no sprue or only a relatively small sprue.

A further advantage of the back-suctioning may result in the case of applications in which the gate to the cast part solidifies before the still partially liquid material in the runner. In that case, it is possible to back-suction melt material which has not yet solidified from the gating cone, with the result that said melt material does not have to be melted again. Depending on the casting mould and the other conditions, this may be a melt material proportion of e.g. up to approx. 5% with respect to the amount of melt introduced into the casting mould.

In a refinement of the invention, in the refilling phase the casting piston is moved back in the period of time when the shut-off valve is closed at a lower speed than in the preceding period of time when the shut-off valve is still open. In other words, in this case the casting piston is moved back during the final back-suctioning stage when the shut-off valve is closed at a lower speed than in the initial refilling stage when the shut-off valve is open. This selection of a non-constant speed profile of the casting piston in the refilling phase advantageously combines a quick initial refilling of the casting chamber with melt with a moderately slower subsequent back-suctioning operation and the casting piston reaching the casting start position.

In a refinement of the invention, in the refilling phase of the casting process, the previously open shut-off valve is closed as soon as the casting piston has reached a valve switchover position by virtue of its return movement. In the case of a shut-off control valve this may be performed by way of an actively controlled valve switchover at this point in time, and in the case of a non-return valve may be performed e.g. in that the casting piston is stopped in the valve switchover position and/or the closed casting mould is opened, and therefore no further melt negative pressure is created in the casting chamber, as a result of which the non-return valve moves in an automatically resetting manner into its closed position. This measure causes the shut-off valve to switch over from its open position to its closed position in dependence on the position of the casting piston, more precisely in dependence on it reaching a particular position, in the present case referred to as valve switchover position or else valve reversal position. The closing of the shut-off valve ends the feed of melt material into the casting chamber via the melt inlet channel, and therefore melt material can be back-suctioned from the melt outlet channel into the casting chamber to the desired extent by the further return movement of the casting piston from its valve switchover position to reaching its casting start position. In the case of a non-return valve, undesired opening of the shut-off valve during this time period can be prevented e.g. in that the casting mould is opened before the casting piston is moved back out of its valve switchover position again. In alternative embodiments, the activation for reversing the shut-off valve from its open position into its closed position during the refilling phase of the casting process is triggered in a different way, e.g. by virtue of the elapsing of a time period, predefinable for this, since the beginning of the refilling phase or since the beginning of the return movement of the casting piston.

In a development of the invention, a stroke distance between the valve switchover position of the casting piston and the casting start position can be variably predefined. This measure makes it possible to react flexibly to different system conditions. The stroke distance between the valve switchover position of the casting piston and the casting start position determines the proportion of the final return movement of the casting piston from its valve switchover position to its casting start position with respect to the entire casting piston stroke, which is given by the distance between the filling end position and the casting start position, and thus also the extent of melt back-suctioning in the melt outlet channel. This stroke distance is naturally greater than zero and smaller than the entire casting piston stroke, i.e. the stroke distance between the filling end position and the casting start position, and can be set to a respectively desired value or value corresponding to the requirements of the respective usage situation, e.g. to a value between approx. 2 mm and 20 mm and more specifically between approx. 4 mm and 8 mm, depending on requirements and the system conditions of the die-casting machine, said value in corresponding implementations being at most half or at most a third or at most a quarter of the entire casting piston stroke, or even less. The extent of back-suctioning of melt material in the melt outlet channel increases as the stroke distance between the valve switchover position and the casting start position increases; the selection of a shorter stroke distance reduces the amount of melt material back-suctioned in the melt outlet channel. The stroke distance between the valve switchover position and the casting start position of the casting piston may be selected differently e.g. for different casting moulds used exchangeably in the die-casting machine. In alternative embodiments, this stroke distance can be predefined in an invariable manner, if a variable adjustment is not required.

In a development of the invention, in the refilling phase of the casting process, the casting piston is held in the valve switchover position during a halt period before it is moved back again to its casting start position. The halt period for the return movement of the casting piston may be used to switch over the shut-off valve from its open position into its closed position and, as required, to open the casting mould. As a result, the shut-off valve can be switched over during a period of time in which there is no moved melt flow in the melt inlet channel and thus through the shut-off valve, but rather the melt material is stationary in the melt inlet channel. The halt period may be set suitably in terms of its temporal duration, e.g. in dependence on the period of time which the shut-off valve requires for switching over from the open position into the closed position and/or which is required for opening the casting mould, it optionally also being possible to provide a variably changeable specification of the halt period. In alternative embodiments, the shut-off valve is switched over from its open position into its closed position without interrupting the return movement of the casting piston, i.e. without the casting piston being completely stopped in its return movement after reaching its valve switchover position.

In a refinement of the invention, in the refilling phase of the casting process, the casting mould is kept closed for at least as long as the shut-off valve is still open. This measure has the result that the casting chamber is refilled with melt material via the melt inlet channel by virtue of the return movement of the casting piston, but no appreciable back-suctioning of melt material in the melt outlet channel takes place yet provided the shut-off valve is in its open position. Then, since the casting mould is still closed and contains the cast part, which is generally at this point in time already at least partially solidified, no appreciable amount of air can pass into the melt outlet channel via said casting mould, and therefore, in this initial stage of the refilling phase, no melt material is back-suctioned from the melt outlet channel into the casting chamber yet. In alternative embodiments, the casting mould is already open and/or the opening thereof has commenced in any case while the shut-off valve is still open.

In a development of the invention, which is suitable in particular if a shut-off control valve is used as shut-off valve, in the refilling phase of the casting process, opening of the casting mould is commenced after the casting piston has reached its casting start position. This procedure brings about the back-suctioning of melt material in the melt outlet channel essentially not until the casting piston has reached its casting start position. As a result of the return movement of the casting piston from the valve switchover position, in which, when it is reached, the shut-off control valve is closed, into the casting start position, the casting piston first builds up a corresponding negative pressure, and after the opening of the casting mould commences, the melt material is then back-suctioned from the melt outlet channel into the casting chamber to a corresponding extent by the associated negative-pressure effect.

In an alternative development of the invention, in the refilling phase of the casting process, opening of the casting mould is commenced after the casting piston has reached its valve switchover position and before it has reached its casting start position. In this procedure, melt material can be back-suctioned in the melt outlet channel or from the melt outlet channel into the casting chamber already during the further return movement of the casting piston into its casting start position. It goes without saying that, in corresponding embodiments, the opening of the casting mould can be commenced at any desired point in time during the return movement of the casting piston from its valve switchover position into its casting start position, and in corresponding implementations further alternatively also already before the casting piston has reached its valve switchover position and the shut-off valve is closed.

In a further development of the invention, in the refilling phase of the casting process, the casting piston is stopped in its valve switchover position and is advanced from its valve switchover position into its casting start position as soon as the casting mould has reached a particular casting-piston-triggering mould opening position when it is opened. In this implementation, the further return movement of the casting piston after being stopped in its valve switchover position is matched to the opening process of the casting mould, specifically in such a way that the casting piston is not advanced to its casting start position until the casting mould has opened by a predefinable extent defined by the set casting-piston-triggering mould opening position. As a result, the process of back-suctioning melt material in the melt outlet channel in the last stage of the refilling phase of the casting process can be further optimized. In alternative embodiments, the return movement of the casting piston takes place without taking into account the current opening position of the casting mould, provided that there is no application-related requirement for this.

In a refinement of the invention, the casting piston is advanced from its casting start position, reached during the refilling phase of a respectively previous casting process, to a pre-filling position during an initial pre-filling stage of the mould-filling phase of a subsequent casting process with the casting mould being not yet completely closed, and only thereafter is the casting mould completely closed and the casting piston advanced further from this pre-filling position to its filling end position. As a result, air which has entered the front region of the melt outlet channel owing to the back-suctioning of melt during the refilling phase of the respectively previous casting cycle can escape at the start of the respectively current casting cycle quickly via the still completely open or at least still partially open mould, before then the mould is completely closed and the actual filling of the mould with the melt material takes place.

According to a further operation method aspect of the invention, which may be provided in addition or as an alternative to the first-mentioned operation method aspect explained above, during a start-of-operation casting process, in a pre-filling phase of the start-of-operation casting process before the mould-filling phase, with the shut-off valve closed, the casting piston in the casting chamber is advanced from a start-of-operation position into a given pre-filling position, and then moved back into its casting start position when the shut-off valve is open. Depending on requirements and the usage situation, the casting mould can be closed already before or at the start of this pre-filling phase or as an alternative can be kept open still during the advancement of the casting piston in this pre-filling phase and closed only before the return movement of the casting piston or when the shut-off valve opens. In the first case, without further measures it is ensured that, during this pre-filling operation, no melt material can exit inadvertently via the still-open mould; in the latter case, air which is pressed out of the melt outlet channel by the pre-filling process can escape more quickly via the still-open mould.

This procedure according to the invention constitutes a specific start-of-operation measure which can be used advantageously when a cyclic casting operation of the die-casting machine for the cyclic casting of a plurality of identical cast parts by means of a specific casting mould in casting processes or casting cycles which follow one another is commenced, e.g. after assembly of the casting mould or the casting tool on the die-casting machine or after a restart of the die-casting machine with a specific assembled casting mould.

In other words, the start-of-operation casting process constitutes a first casting process or casting cycle for producing the desired cast part after a start of operation of the machine. At such a start of operation, the melt material is not yet located in a front region of the melt outlet channel but rather at most in a rear region of the melt outlet channel, e.g. up to the height of a melt fill level in the casting chamber or a melt bath in which a casting container containing the casting chamber is immersed. The specific start-of-operation casting process ensures that the melt material is present in a front region of the melt outlet channel also already for the first of many casting processes which follow one another after such a start of operation of the machine when the mould-filling phase is commenced, in that the casting piston is advanced out of its casting start position in the direction of its filling end position, in order to press the melt material into the casting mould.

For this purpose, before this mould-filling phase, in the pre-filling phase of the start-of-operation casting process the casting piston is advanced from its start-of-operation position, in which it is situated at this point in time, initially only into the pre-filling position, the shut-off valve remaining closed, with the result that melt material from the casting chamber can be pressed into the melt outlet channel. The pre-filling position of the casting piston is determined by the fact that, when it is reached, the melt material has filled the melt outlet channel to a desired, predefinable extent. The subsequent opening of the shut-off valve and the return movement of the casting piston from its pre-filling position into its casting start position, which may correspond to the start-of-operation position or a position, further in front, of the casting piston in the casting chamber between the start-of-operation position and the pre-filling position, refills the casting chamber again with melt material via the melt inlet channel to a maximum extent in an amount which was pressed previously from the casting chamber into the melt outlet channel.

For the subsequent first casting process after the start of operation of the machine, in this way the same or similar conditions in terms of melt material which is available already up to a front region of the melt outlet channel are present as for the subsequent further casting processes in the started casting operation of the machine. In other words, in that case the melt material in the melt outlet channel is already available for this first casting process already up to a front region thereof, e.g. in the entire volume of a riser-channel portion and in the volume of an adjoining mouthpiece body portion of the melt outlet channel up to the front end region of the mouthpiece body and thus also significantly above the bath level of an assigned melt bath from which the melt material is fed to the casting chamber. This results in the advantage that by virtue of this singular pre-filling, at the start of operation the casting piston stroke required for the subsequent actual mould-filling phase can be significantly reduced already for the first casting cycle after the start of operation. In alternative embodiments, instead of this pre-filling measure, after the start of operation of the machine the first casting process is carried out with a casting stroke of the casting piston that is correspondingly longer than that of the further casting processes in the started period of operation.

The die-casting machine according to the invention comprises a casting mould, a casting chamber, a casting piston arranged in an axially movable manner in the casting chamber, a melt inlet channel which leads into the casting chamber, a shut-off valve in the melt inlet channel, a melt outlet channel which leads from the casting chamber to the casting mould, and a control unit for controlling the casting piston.

According to the invention, for the purpose of carrying out a respective casting process in a mould-filling phase, the control unit and the shut-off valve are configured to bring the shut-off valve into a closed position and to control the casting piston in the casting chamber to advance from a casting start position to a filling end position, in order to press melt material into the casting mould via the melt outlet channel, and in a subsequent refilling phase firstly to bring the shut-off valve into an open position and to control the casting piston to move back to the casting start position, in order to feed melt material to the casting chamber via the melt inlet channel.

The control unit and the shut-off valve are further configured to bring the shut-off valve into its closed position again still during the refilling phase, before the casting piston has reached its casting start position by virtue of its return movement, and to control the casting piston to back-suction melt material in the melt outlet channel by virtue of the further return movement of the casting piston, and/or during a start-of-operation casting process to control the casting piston to advance in the casting chamber from a start-of-operation position to a pre-filling position during a pre-filling phase of the start-of-operation casting process before the mould-filling phase with the shut-off valve closed, and then to bring the shut-off valve into its open position and to control the casting piston to move back to its casting start position.

As a result, this die-casting machine is suitable in particular for carrying out the aspects mentioned of the operating method according to the invention.

In a refinement of the invention, the shut-off valve is in the form of a shut-off control valve, and the control unit is configured to control the shut-off control valve. This allows active control of the shut-off valve by means of the control unit, in particular in order to bring it into its respectively desired open or closed position in the course of a casting process.

In a development of the invention, the die-casting machine contains a valve actuator, activated by the control unit, for actuating the shut-off control valve. The actuator functions as a linking element between the control unit and the shut-off valve and may be suitably selected depending on the type of the control unit and the shut-off valve, e.g. of an electrical, magnetic, hydraulic, pneumatic or mechanical type. As an alternative, the valve actuation functionality may be integrated e.g. directly in the control unit.

In a refinement of the invention, the shut-off valve is in the form of a non-return valve which is preloaded in its closed position. This constitutes an alternative to the implementation as a shut-off control valve. In this case, the shut-off valve is controlled or actuated in dependence on the pressure of the melt material acting on it, in particular on the melt pressure in the casting chamber.

In a refinement of the invention, the die-casting machine contains a valve sensor unit for sensing one or more measured variables of the shut-off valve. This can be used e.g. to give feedback about the current position of the shut-off valve to the control unit by way of the valve sensor unit and/or to provide valve diagnosis information which provides information as to whether the shut-off valve operates in an error-free manner and/or in which state of use it is located and whether it requires e.g. maintenance.

Advantageous embodiments of the invention are illustrated in the drawings. These embodiments and further embodiments of the invention are explained in more detail below.

DETAILED DESCRIPTION OF THE DRAWINGS

Figure 1:
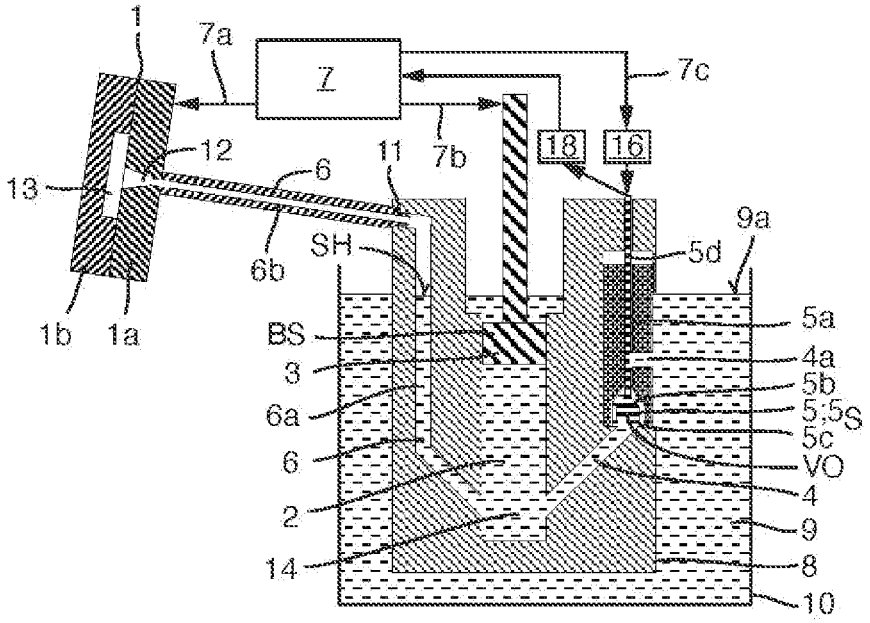
FIG. 1 shows a schematic longitudinal sectional view of a part, of interest in the present case, of a die-casting machine having a shut-off control valve as shut-off valve.
Figure 2:
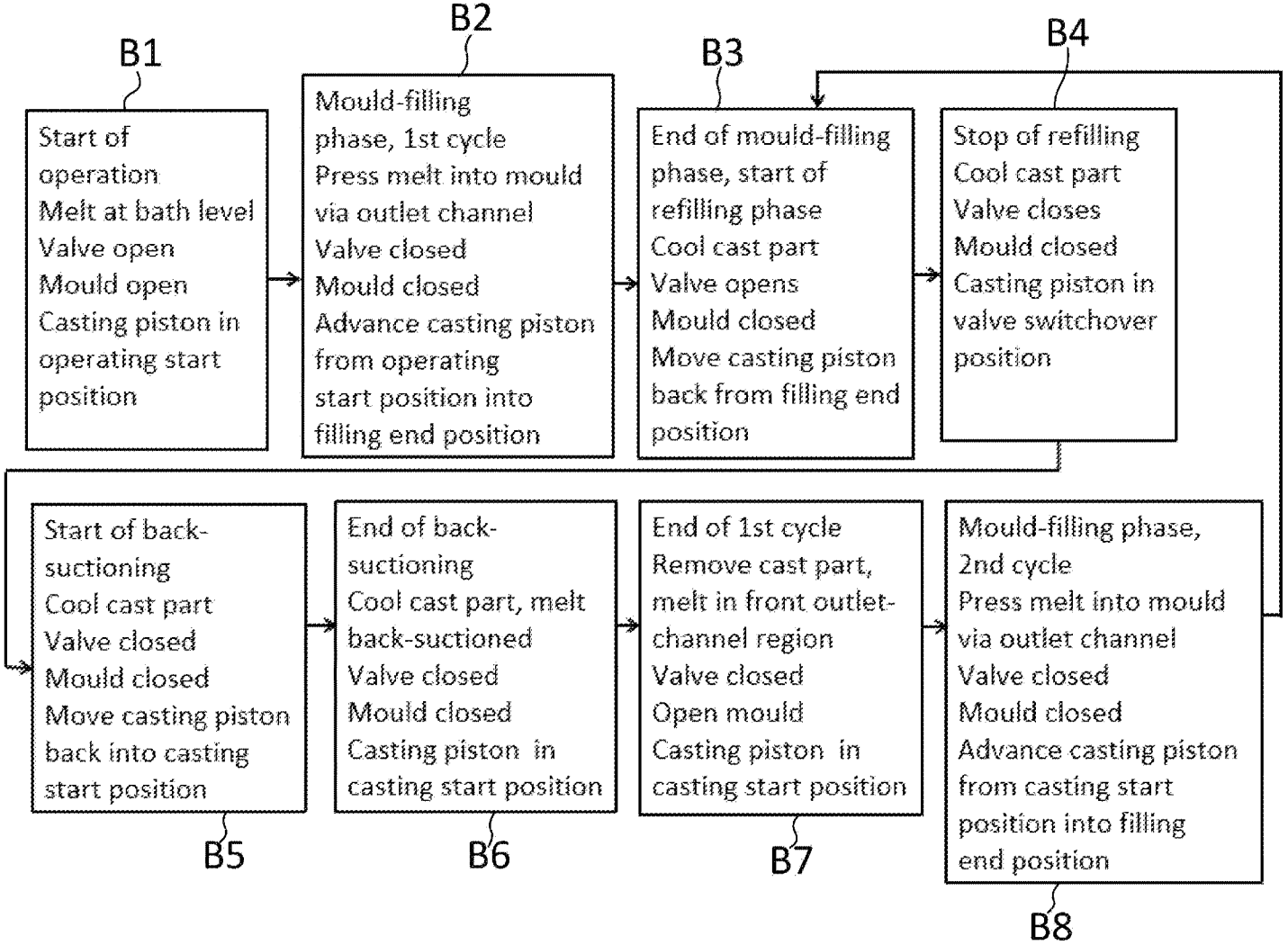
FIG. 2 shows a flow diagram for illustrating an operating method for the die-casting machine from FIG. 1 from a start of operation.
Figure 10:
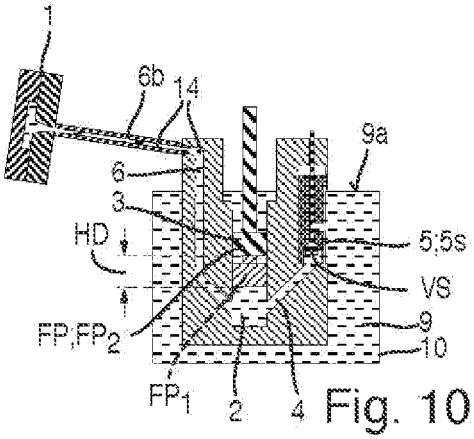
FIG. 10 shows the view from FIG. 3 at the end of the mould-filling phase of a second casting cycle.
Figure 11:
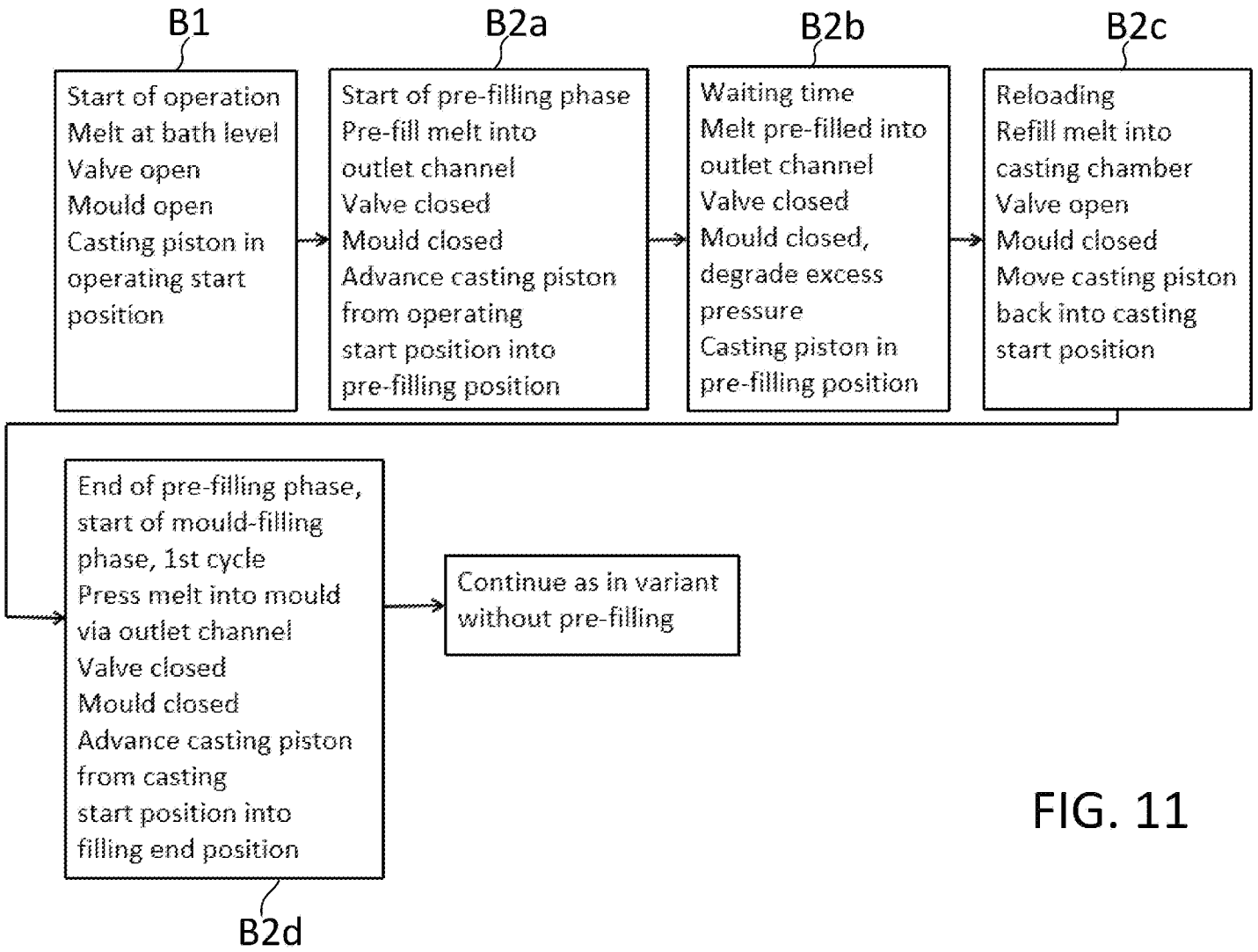
FIG. 11 shows a flow diagram for illustrating an operating method for the die-casting machine from FIG. 1 in a variant with an initial pre-filling phase after the start of operation.
Figure 14:
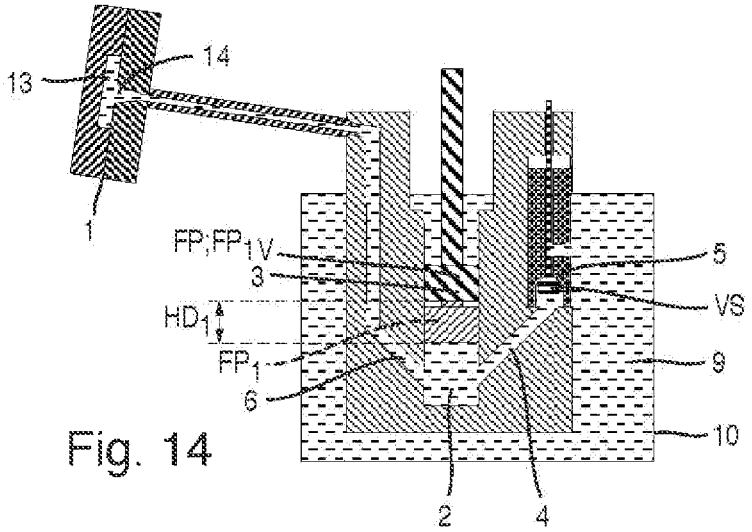
FIG. 14 shows the view from FIG. 12 at the end of a mould-filling phase, following the initial pre-filling phase, of the first casting cycle in the method variant from FIG. 11.
Figure 15:
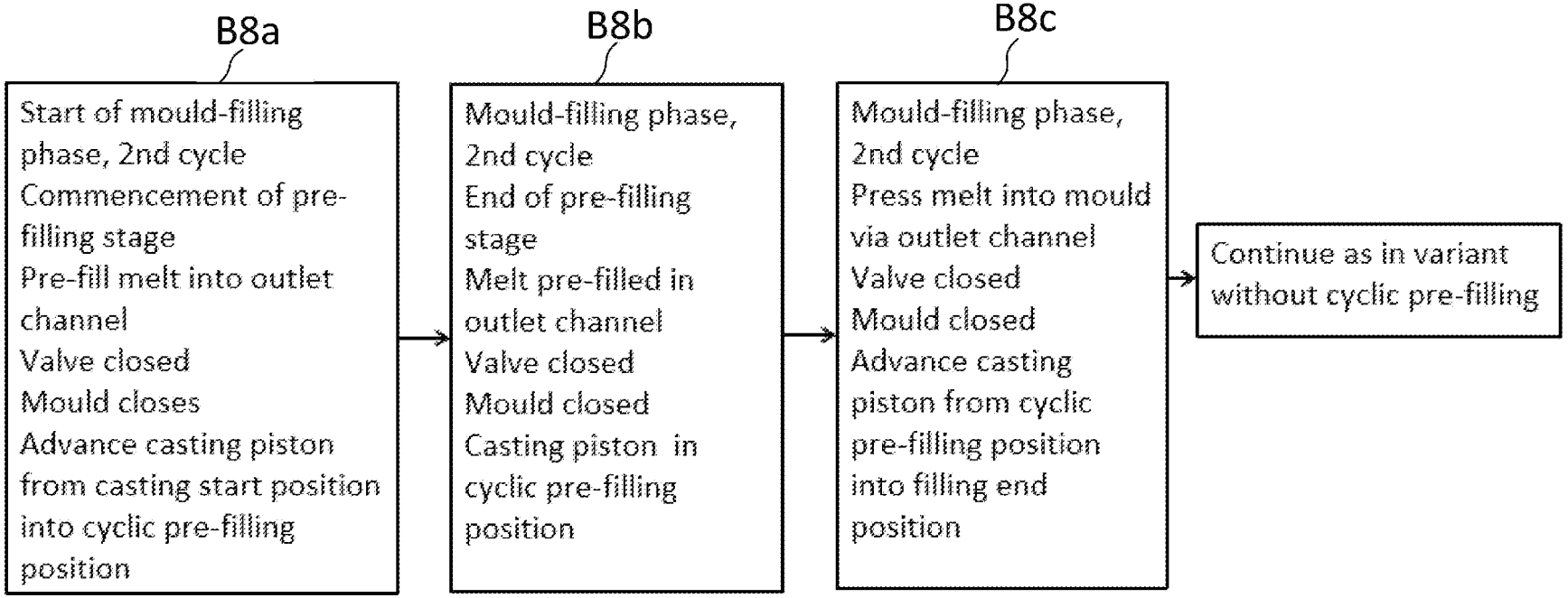
FIG. 15 shows a flow diagram for illustrating an operating method for the die-casting machine from FIG. 1 in a variant with cyclic pre-filling before the mould-filling phase of a respective casting cycle.

FIGS. 2, 11 and 15 illustrate various advantageous variants of the inventive method for operating the die-casting machine in a flow diagram. FIGS. 1, 3 to 10 and 12 to 14 and FIG. 16 schematically show the part of interest here of a die-casting machine in two implementations according to the invention, which may be operated by way of the method according to the invention. This die-casting machine may be in particular one of the hot-chamber type for die casting liquid or partially liquid metal melts, such as zinc, lead, aluminium, magnesium, titanium, steel, copper, and alloys of these metals. For this purpose, the die-casting machine comprises in particular a casting mould 1 which has a fixed mould half 1*a* and a movable mould half 1*b*, a casting chamber 2, a casting piston 3 arranged in an axially moveable manner in the casting chamber 2, a melt inlet channel 4 which leads into the casting chamber 2, a shut-off valve 5 in the melt inlet channel 4, a melt outlet channel 6 which leads from the casting chamber 2 to the casting mould 1, and a control unit 7.

Figure 16:
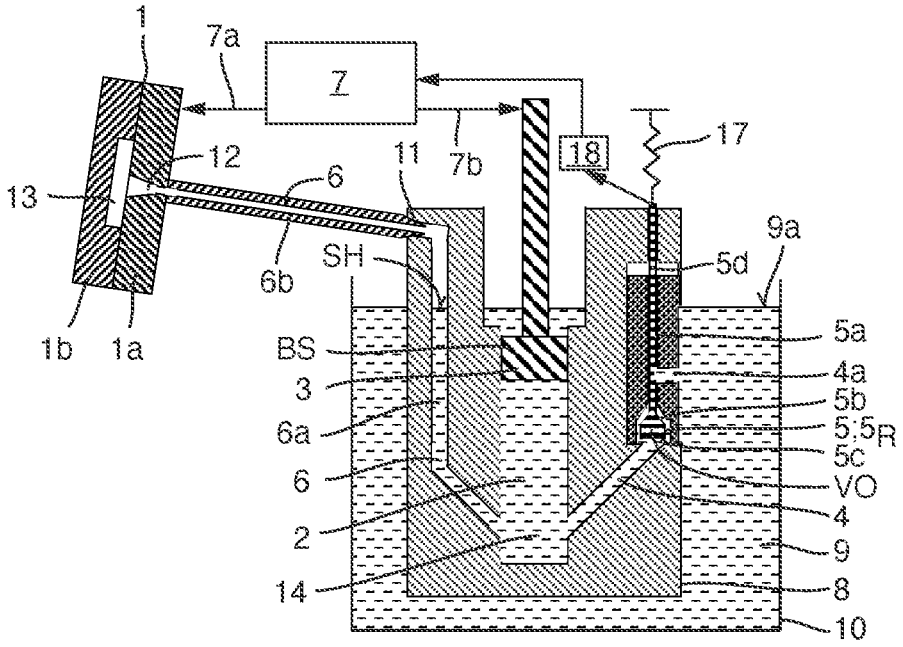
FIG. 16 shows the view from FIG. 1 for a variant of the die-casting machine having a non-return valve as shut-off valve.

In the example of FIGS. 1, 3 to 10 and 12 to 14, the shut-off valve 5 is configured as a shut-off control valve $\mathbf{5}_S$, i.e. as an activatable shut-off valve, which is activated by the control unit 7 directly or, as in the example shown, by way of an optional valve actuator 16. The valve actuator 16 may be any desired actuator of the conventional type, as is known to a person skilled in the art for actuating such a valve per se. In this respect, depending on requirements and the usage situation, the actuator 16 may be in particular of a conventional electrically operating, hydraulically operating, pneumatically operating or mechanically directly operating actuator type, or an actuator type which operates mechanically by way of a lever system etc. In this respect, depending on requirements and the usage situation, the valve actuator 16 may be an actuator type which operates in a purely binary manner and switches over the shut-off valve 5 only between a first, open position and a second, closed position, or alternatively a proportional actuator type, which can open the shut-off valve 5 continually or in multiple stages, i.e. can also bring the shut-off valve 5 into one or more partial opening positions between its completely open position and its completely closed position and keep it there. For this purpose, as required, the valve actuator may comprise e.g. variably settable end stops, which can be adjusted manually or automatically. In a schematic illustration corresponding to FIG. 1, FIG. 16 shows a variant of the die-casting machine which differs from that in FIG. 1 in that the shut-off valve 5 is configured as a non-return valve $\mathbf{5}_R$.

In the present case, the control unit 7 is understood to mean encompassing all control elements of the die-casting machine for controlling and/or regulating the various components of the machine, for which purpose the control unit 7, depending on the system configuration, may contain a single control device in which all control functionalities are integrated, or a plurality of individual control devices, each of which controls and/or regulates specific machine components and which preferably have a communication link with one another. Similarly, as is customary, the control unit 7 may be configured at least partially in hardware and/or at least partially as software. Shown purely symbolically and in a representative manner to illustrate all machine control functionalities of the control unit 7 are activation arrows 7*a*, 7*b*, 7*c* which lead from the control unit 7 to the casting mould 1, to the casting piston 3 and to a valve rod 5*d* of the shut-off valve 5, respectively, the control functions belonging to these machine components being of primary interest in the present case. For the sake of simplicity, the schematic illustration of the control unit 7 is only present in FIG. 1; by contrast, it is omitted in FIGS. 3 to 10 and 12 to 14.

Unless referred to in more detail below, both the control unit 7 and the rest of the machine components mentioned have a structure which is conventional per se and familiar to a person skilled in the art, and therefore requires no further explanation here. In the example shown, as can be seen e.g. in FIG. 1, the casting chamber 2 is formed in a casting container 8 of a casting unit which is customary in this respect, the casting container 8 being immersed in a melt bath 9 located in a conventional melt container 10 during the casting operation.

In the examples shown, the shut-off valve 5 is held on the casting container 8 by means of a valve housing body 5*a*. Located on the valve housing body 5*a*, as an alternative at a different position on the casting container 8, are one or more inlet openings in the form of an ingress 4*a* for the melt inlet channel 4, i.e. melt material 14 can pass from the melt bath 9 via the ingress 4*a* into the melt inlet channel 4. The shut-off valve 5 is located specifically with a fixed valve seat 5*b* and a moveable valve closing body 5*c* in the melt inlet channel 4, it being possible in the example shown for the valve closing body 5*c* to be moved so as to rest axially against the valve seat 5*b* and away from it by way of the valve rod 5*d*, in order to close and open the shut-off valve 5, respectively, i.e. to switch it over between an open position VO shown e.g. in FIG. 1 and a closed position VS shown e.g. in FIG. 3. In this respect, depending on the valve configuration and/or operating situation, the open position VO may be a completely open position or a partially open position of the valve. In alternative embodiments, not shown, the shut-off valve 5 is arranged in the casting piston 3, in this case the melt inlet channel 4 leading via the casting piston 3, in particular through it, as is known per se.

In the machine configuration of FIGS. 1, 3 to 10 and 12 to 14, as already mentioned, the switchover movement of the shut-off valve 5, i.e. the shut-off control valve $\mathbf{5}_S$, is performed by the control unit 7 by way of the optional valve actuator 16. In the machine configuration of FIG. 16, the switchover movement of the shut-off valve 5, i.e. the non-return valve $\mathbf{5}_R$, is performed in dependence on the melt pressure in the casting chamber 2, the non-return valve $\mathbf{5}_R$ being biased in its closed position VS by a preloading unit 17 of the conventional type. When a corresponding melt negative pressure is present in the casting chamber 2, the non-return valve $\mathbf{5}_R$ is moved from its closed position VS into its open position VO by this negative pressure counter to the preload force of the preloading unit 17. As soon as the melt negative pressure is no longer present, the non-return valve $\mathbf{5}_R$ returns automatically to its closed position VS by virtue of the action of the preloading unit 17. The preloading unit 17 may be implemented e.g. by a preload spring, such as a correspondingly designed and arranged compression or tension spring, the preloading unit 17 in FIG. 16 being represented purely by way of example and schematically by an illustration of a tension spring.

The melt outlet channel 6 leads in a conventional manner out of the casting chamber 2 via a riser-channel region and/or riser-tube portion 6*a* formed in the casting container 8 and then continues via a mouthpiece body 6*b* to the region of the mould 1. For this purpose, in a likewise conventional manner, the mouthpiece body 6*b* is coupled on the inlet side to a mouthpiece attachment 11, with which the riser-tube portion 6*a* opens out of the casting container 8, and leads on the outlet side to the region of a gating cone 12 in the fixed mould half 1*a* in front of a mould cavity 13, which, when the casting mould 1 is closed, is formed by the two mould halves 1*a*, 1*b* and is designed in dependence on the cast part to be produced.

FIG. 2 illustrates the operating method according to the invention in an exemplary embodiment variant at a start of operation of the die-casting machine, i.e. after starting the machine for the purpose of casting a desired number of identical cast parts in a corresponding number of casting processes or casting cycles which follow one another. FIGS. 1 and 3 to 10 illustrate the machine schematically in different operating stages during the operation according to the embodiment variant from FIG. 2. In this respect, the machine in FIGS. 3 to 10 is shown only for the sake of simplicity in the embodiment from FIG. 1, but the associated statements below apply in the same way for the machine configuration from FIG. 16, unless mentioned otherwise.

In an initial operating stage B1 of FIG. 2, the machine is in a basic state at the start of operation. FIG. 1 shows the machine in this operating stage B1 with the exception that the casting mould 1, which is still open in the basic state, is shown already in its closed state. The casting piston 3 is accordingly located in an operating start position BS. The shut-off valve 5 is still open, and therefore the melt material 14 is present everywhere up to the height of a melt bath level 9*a* of the melt bath 9. In particular, the melt material 14 is also situated in the melt outlet channel 6 at an identical melt level SH corresponding to the melt bath level 9*a*, the melt material 14 extending for example as far as a central or front region of the riser-channel portion 6*a* and not yet as far as the mouthpiece body 6*b*.

Figure 3:
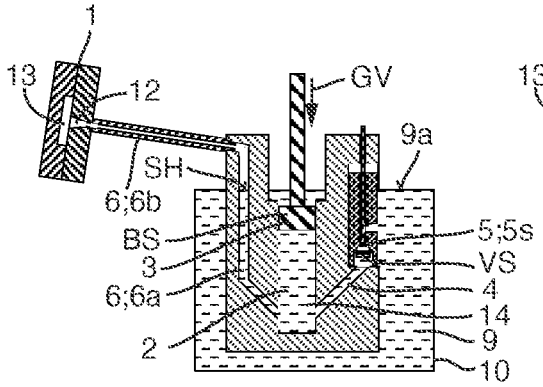
FIG. 3 shows the view from FIG. 1 during operation of the machine according to the method from FIG. 2 at the beginning of a mould-filling phase of a first casting cycle.
Figure 4:
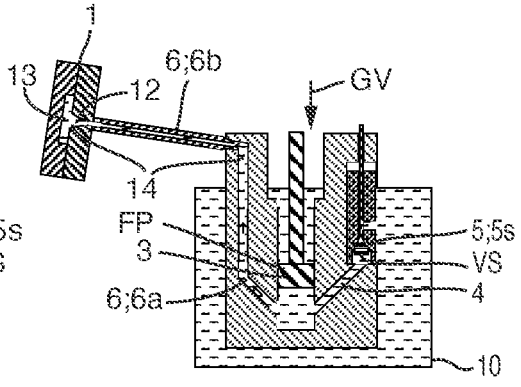
FIG. 4 shows the view from FIG. 3 during the mould-filling phase.

In a subsequent operating stage B2 of FIG. 2, a first casting cycle is initiated, and an associated mould-filling phase is carried out for this. For this purpose, firstly the casting mould 1 is closed, and the shut-off valve 5 is brought from its open position VO into its closed position VS and/or kept there, whether it is in the form of a shut-off control valve $\mathbf{5}_S$ controlled by the control unit 7 or in the form of a non-return valve $\mathbf{5}_R$ controlled automatically by the preloading unit 17. FIG. 3 shows the machine at this point in time. After this, the casting piston 3 is advanced from the operating start position BS to a filling end position FP, i.e. downwards in each of FIGS. 1, 3 to 10 and 12 to 14, with the result that melt material 14 is pressed from the casting chamber 2 via the melt outlet channel 6 into the casting mould 1. The advancing movement of the casting piston 3 is symbolized in the corresponding figures by an associated movement direction arrow GV. The melt flow in the melt outlet channel 6 is indicated in FIG. 4 symbolically by corresponding flow arrows, FIG. 4 showing the machine at the end of this mould-filling phase, which in a known manner may include what is known as a follow-up or holding pressure phase, in which an additional, increased follow-up or holding pressure is exerted on the melt material 14 in the mould 1.

Figure 5:
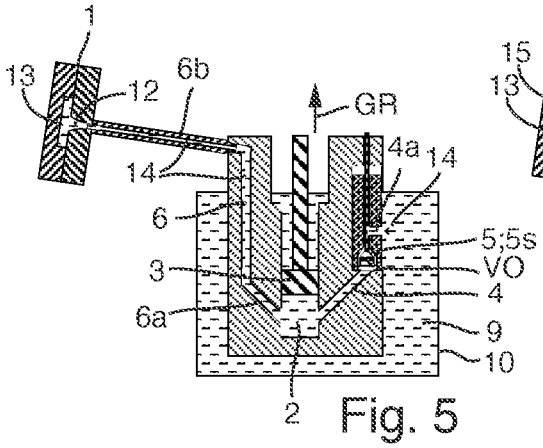
FIG. 5 shows the view from FIG. 3 after the mould-filling phase has ended and at the beginning of a refilling phase of the first casting cycle.
Figure 6:
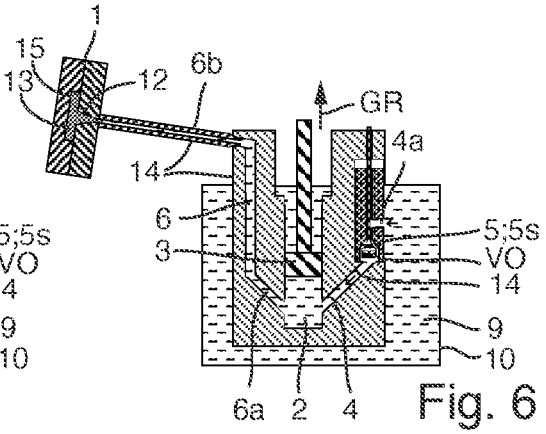
FIG. 6 shows the view from FIG. 3 during the refilling phase.

In an operating stage B3 of FIG. 2, the mould-filling phase is ended and a refilling phase and/or piston return phase follows. For this purpose, the shut-off valve 5 is switched over from its closed position VS into its open position VO, and the casting piston 3 is moved back out of its filling end position FP, i.e. upwards in the relevant figures. The switching over of the shut-off valve 5 takes place controlled by the control unit 7 in the case of the shut-off control valve $\mathbf{5}_S$, and by the melt negative pressure which is produced in the casting chamber 2 on account of the return movement of the casting piston 3 in the case of the non-return valve $\mathbf{5}_R$. It should be mentioned here that naturally, depending on the machine type, the advancing or return movement of the casting piston 3 may be oriented not in the vertical direction, as in the example shown, but rather perpendicularly or inclined with respect to the vertical direction. The casting mould 1 initially remains closed, and the so-called cooling time passes, during which the melt material 14 in the mould cavity 13 is cooled, with the result that the melt material 14 which solidifies there forms a desired cast part 15. The return movement of the casting piston 3 sucks and thus refills melt material 14 from the melt bath 9 via the melt inlet channel 4 into the casting chamber 2. FIGS. 5 and 6 show the machine at an initial and somewhat later point in time, respectively, of the refilling phase, during which melt material 14 from the melt bath 9 refills the casting chamber 2, as illustrated by corresponding flow arrows. The return movement of the casting piston 3 is symbolized in the corresponding figures by an associated movement direction arrow GR.

Figure 7:
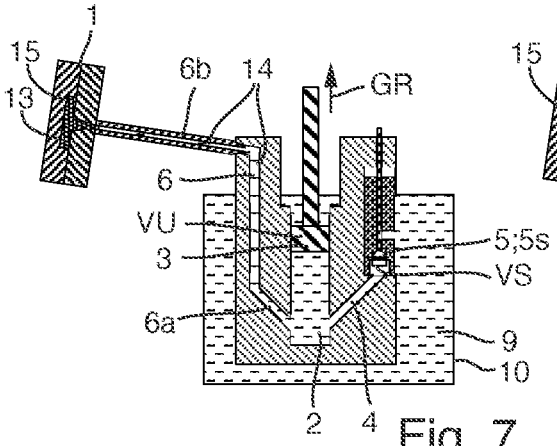
FIG. 7 shows the view from FIG. 3 after the refilling of the casting chamber with melt has ended.

In an operating stage B4 of FIG. 2, the refilling of the casting chamber 2 with melt material 14 from the melt bath 9 via the melt inlet channel 4 is ended by switching over the shut-off valve 5 from its open position VO into its closed position VS. In the case of the shut-off control valve $\mathbf{5}_S$, this is brought about by the control unit 7, and in the case of the non-return valve $\mathbf{5}_R$, this is brought about by stopping the return movement of the casting piston 3 and thereby no longer creating a melt negative pressure in the casting chamber 2, with the result that the non-return valve $\mathbf{5}_R$ returns automatically to its closed position VS by virtue of its preloading unit 17. At this point in time, the casting piston 3 is located in a corresponding valve reversal position and/or valve switchover position VU. The casting piston 3 is preferably held there for a halt period, the temporal duration of which can be suitably predefined, in particular in such a way that the shut-off valve 5 has reached its closed position VS when the halt period has elapsed. Optionally, it is also possible in this respect to select the halt period corresponding to a switchover duration of the shut-off valve 5 from its open position VO into its closed position VS, or to monitor when the shut-off valve 5 has reached its closed position VS, and then to end the halt period or continue to move the casting piston 3. FIG. 7 shows the machine at this point in time. Meanwhile, the cooling time for the melt material 14 in the casting mould 1 for the purpose of forming the cast part 15 continues.

Figure 8:
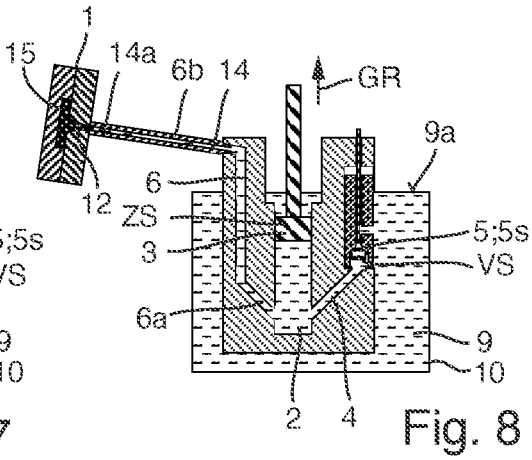
FIG. 8 shows the view from FIG. 3 during a melt back-suctioning operation which follows the melt refilling operation.

After the halt period has elapsed or the valve switchover position VU has been passed through, or after the shut-off valve 5 has been closed, in an operating stage B5 of FIG. 2 the casting piston 3 is moved back further to a casting start position GS for a subsequent, second casting process, as a result of which a melt back-suctioning process begins. The casting start position GS may be identical to the initial operating start position BS of the casting piston 3 or may differ therefrom to a limited extent. FIG. 8 shows the machine in an intermediate position ZS of the casting piston 3 during this return movement of the casting piston 3 beyond the valve switchover position VU or out of the valve switchover position VU.

In this respect, in the variant with the shut-off control valve $\mathbf{5}_S$, it is held in a controlled manner in its closed position VS, and the casting mould 1 is not yet opened, with the result that the further return movement of the casting piston 3 brings about a suction effect on the melt outlet channel 6 via the casting chamber 2. This produces a negative pressure in the region of the gating cone 12, in that the melt material 14 is drawn back already somewhat from the exit, lying to the front, of the melt outlet channel 6, in the example shown specifically of the mouthpiece body 6*b*, as indicated in FIG. 8 by a back-suction arrow 14*a*.

In the variant with the non-return valve $\mathbf{5}_R$, insofar as it differs from the above procedure selected in the variant with the shut-off control valve $\mathbf{5}_S$ and indicated in FIG. 2 in relation to the operating stage B5, at this point in time before the further return movement of the casting piston 3, the casting mould 1 is opened at least by a predefinable extent, the cooling time having elapsed or the end thereof being waited for. As a result, the melt outlet channel 6 is no longer sealed in an airtight manner with respect to the external atmosphere on the side of the casting mould 1, which has the consequence of melt negative pressure no longer building up in the casting chamber 2 during the further return movement of the casting piston 3. Accordingly, the non-return valve $\mathbf{5}_R$ remains in its closed position VS. Instead, the melt material 14 specifically in the front region of the mouthpiece body 6*b* is drawn back further away from the region of the gating cone 12, i.e. a limited back-suctioning of melt material from the outlet-side region, furthest in front, of the melt outlet channel 6 takes place, this preventing the formation of a melt droplet in the region of the gating cone 12.

The further return movement of the casting piston 3 from the valve switchover position VU to the casting start position GS preferably takes place at a piston speed which is notably lower than the piston speed at which the casting piston 3 was previously moved back from the filling end position FP to the valve switchover position VU.

The stroke distance between the valve switchover position VU and the casting start position GS of the casting piston 3 determines the extent of back-suctioning of melt material 14 in the melt outlet channel 6, it optionally being possible to provide that this stroke distance can be variably predefined or set by the user.

While in the example shown, the point in time of the switching over of the shut-off valve 5 into its closed position VS to end the refilling of the casting chamber 2 with melt material 14 from the melt bath 9 is coupled to the casting piston 3 reaching the valve switchover position VU, in alternative embodiments this valve switchover is triggered in another way, e.g. after a certain period of time has elapsed since the beginning of the return movement of the casting piston 3 from its filling end position FP.

Figure 9:
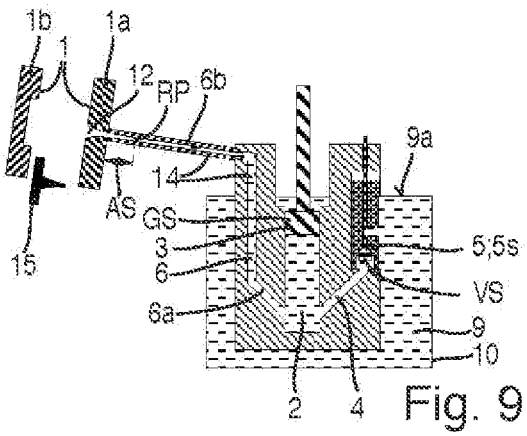
FIG. 9 shows the view from FIG. 3 towards the end of the first casting cycle.

In an operating stage B6 of FIG. 2, the return movement of the casting piston 3 is then terminated after it reaches its casting start position GS. In the meantime, it is then also the case in the variant with the shut-off control valve $\mathbf{5}_S$ that the cooling time for the complete solidification of the formed cast part 15 in the mould 1 has elapsed, and accordingly it is possible in this variant, in a subsequent operating stage B7 from FIG. 2, to commence the opening of the casting mould 1 by virtue of a corresponding opening movement of the moveable mould half 1*b*, as illustrated in FIG. 9, which shows the machine at this operating time. The opening of the mould 1 makes it possible to instantaneously release the back-suctioning negative pressure, created previously in the variant with the shut-off control valve $\mathbf{5}_S$, in the region of the gating cone 12, as a result of which the melt material 14 in the front region of the melt outlet channel 6, in the example shown specifically in the front region of the mouthpiece body 6*b*, is drawn back further away from the region of the gating cone 12. Again, the drawing back, i.e. limited back-suctioning, of the melt material 14 from the outlet-side region, furthest to the front, of the melt outlet channel 6 prevents the formation of a melt droplet in the region of the gating cone 12, as explained above in relation to the variant with the non-return valve $\mathbf{5}_R$. In both variants, it is then possible to remove the cast part 15 formed in each case after the mould 1 has been completely opened.

FIG. 9 shows by way of example the melt material 14 being present in the front region of the melt outlet channel 6 up to a back-suction point RP, which maintains a desired, sufficient distance AS from the region of the gating cone 12 or the exit of the melt outlet channel or the melting-away point at which the back-suctioned melt material 14 breaks away from the solidified or partially solidified melt material remaining in the mould 1 and in the gating cone 12. This makes it possible to reliably prevent said droplet formation, this distance AS in FIG. 9 being exaggerated merely for the sake of clarity and not being shown as true to scale. The distance AS is for example approx. 5 mm to 100 mm from the gating cone 12, at which the melt droplet would otherwise form, in particular e.g. between approx. 10 mm and approx. 50 mm, preferably e.g. between approx. 30 mm and approx. 40 mm, depending on requirements, the viscosity of the melt material and/or the system configuration of the machine, inter alia depending on the diameter of the casting piston, rising bore and mouthpiece body. As an alternative, the distance AS may also be greater, wherein as the distance AS becomes larger, more air is present in the outlet-side region of the melt outlet channel 6 before the beginning of the next casting cycle.

In any case, however, the melt outlet channel 6 remains filled with melt material 14 above the melt bath level 9*a* of the melt bath 9, with the result that, in the next casting cycle, the melt material 14 in the melt outlet channel 6 does not need to be advanced from the melt bath level 9*a* as in the first casting cycle after the start of operation according to FIG. 3, but rather the melt level SH in the melt outlet channel 6 is considerably above the melt bath level 9*a* already at the beginning of the next casting cycle and the melt material 14 is preferably available already in the front region of the melt outlet channel 6. In this way, the first casting cycle is terminated after the operating stage B7 of FIG. 2.

To carry out the next, second casting cycle, the mould 1 is then closed in an operating stage B8 of FIG. 2 and the casting piston 3 is moved from its casting start position GS to its filling end position FP, in order to again press the melt material 14 from the casting chamber 2 via the melt outlet channel 6 into the closed mould 1. FIG. 10 shows the machine at the end of the mould-filling phase of this second casting cycle corresponding to the machine state, shown in FIG. 4, at the end of the mould-filling phase of the first casting cycle.

As illustrated in a comparative manner in FIG. 10, in the second casting cycle an axial movement stroke of the casting piston 3 from the casting start position GS to the filling end position FP that is smaller than in the first casting cycle for advancing the casting piston 3 from the operating start position BS to the filling end position FP is sufficient, since for the second casting cycle the melt material 14 is already present significantly above the melt bath level 9*a* in the melt outlet channel 6. In other words, as shown schematically in FIG. 10, the filling end position FP in the second casting cycle is located at an end position $FP_2$ with respect to the position in the casting chamber 2 that is further back, i.e. further to the top in FIG. 10, than that end position $FP_1$ which is assumed by the casting piston 3 as filling end position FP in the first casting cycle.

Expressed differently, a stroke distance $HA=FP-GS=FP_2-GS$ between the filling end position FP and the casting start position GS for the second and each further casting cycle of a corresponding active operation interval of the machine is lower than the corresponding stroke distance $HA=FP-BS=FP_1-BS$ between the filling end position FP and the operating start position GS for the first casting cycle, the difference being determined by the amount of melt material 14 which is present after the first and before the second casting cycle in the melt outlet channel 6 above the melt bath level 9*a*. The stroke difference is illustrated in FIG. 10 by a corresponding stroke deviation $HD=FP_1-FP_2$ of the filling end position $FP_1$ after the first casting cycle with respect to the filling end position $FP_2$ after the second casting cycle. The shortening of this stroke length for the second casting cycle and the further casting cycles may be for example up to 30% or up to 50% or more, depending on the machine type and the cast part 15 to be produced.

This shortening of the stroke length, which the casting piston 3 has to travel during the mould-filling phase, correspondingly allows a shortening of the cycle time, i.e. the duration of the respective casting cycle for the second and each further casting cycle within the operation interval, e.g. by up to 5% or 10%. Moreover, owing to the melt material 14 remaining in the melt outlet channel 6 above the melt bath level 9*a* between the casting cycles, the air fraction to be displaced in the outlet-side part of the melt outlet channel 6 is reduced, as a result of which the air incorporated in the cast part can also be reduced, this benefitting the quality of the cast part. In addition, the shortening of the casting piston stroke makes it possible to reduce the wear effects for the casting piston and the casting chamber caused by the casting piston movement in the casting chamber.

Then, the mould-filling phase and the subsequent refilling phase of the second casting cycle proceed in the same way as explained above for the first casting cycle, to which reference can be made. This is symbolized in FIG. 2 by a return arrow from the operating stage B8 to the operating stage B3.

In the exemplary embodiment shown with the shut-off control valve $\mathbf{5}_S$ as shut-off valve 5, the casting mould 1 remains closed in a corresponding procedure during the entire refilling phase, until the casting piston 3 has reached its casting start position GS as the start position for the next casting cycle. The fact that the mould 1 is opened only at this point in time then leads to the instantaneous back-suction effect mentioned. In alternative procedures, the casting mould 1 may be opened earlier, and as a result the back-suction effect can be configured and/or weakened more homogeneously in terms of time. In this respect, in corresponding operation variants, the casting mould 1 remains closed at least for as long as the shut-off control valve $\mathbf{5}_S$ is still open for the purpose of refilling the casting chamber 2 with melt material 14 from the melt bath 9. When the casting piston 3 has reached its valve switchover position VU and the shut-off control valve 5 has been closed thereby, depending on requirements the casting mould 1 is opened at an earlier or later point in time of the further return movement of the casting piston 3 from the valve switchover position VU into the casting start position GS. As soon as the opening of the mould 1 is commenced, more air can pass via the exit of the melt outlet channel 6 into the front region of the melt outlet channel 6 and as a result weaken and/or alleviate the negative-pressure effect there.

In a further operation variant, the casting piston 3 is held in the valve switchover position VU, and the opening of the casting mould 1 is then commenced after the cooling time has elapsed. As soon as the casting mould 1, as it opens, has reached a determined casting-piston-triggering mould opening position which can be predefined in a variable or permanent manner, e.g. when the moveable mould half 1*b* has moved away from the fixed mould half 1*a* by a corresponding predefinable travel length, the casting piston 3 is moved back further from its valve switchover position VU to its casting start position GS. In this respect, the casting-piston-triggering mould opening position is selected such that an entry of air at the melt outlet channel 6 via the gating cone 12 or the mouthpiece nozzle is possible. This may then result in back-suctioning of the melt material 14 in the region, furthest to the front, of the melt outlet channel 6 in a relatively homogeneous variation over time without a sudden degradation of the negative pressure. This operation variant is suitable e.g. particularly also for the machine variant of FIG. 16 with the non-return valve $\mathbf{5}_R$ as shut-off valve 5. Then, as soon as the mould 1 has been opened in this way by an extent sufficient for air to enter at the melt outlet channel 6, melt negative pressure is no longer created in the casting chamber 2 by the further return movement of the casting piston 3, and the non-return valve $\mathbf{5}_R$ remains automatically in its closed position VS by virtue of the action of the preloading unit 17.

FIG. 11 illustrates the method for operating the die-casting machine according to the invention in a further advantageous embodiment variant, which relates specifically to the performance of the respective first casting cycle after the start of operation of the machine and which is suitable primarily for the machine variant with the shut-off control valve $\mathbf{5}_S$ as shut-off valve 5. For this purpose, this operation variant proceeds again from the basic state of the machine at a start of operation according to the initial operating stage B1 of FIG. 2. In contrast to the operation variant of FIG. 2, however, in the operation variant of FIG. 11, a start-of-operation casting process, i.e. a specific first casting cycle, in which an initial pre-filling phase is performed upstream of the mould-filling phase is now carried out.

Figure 12:
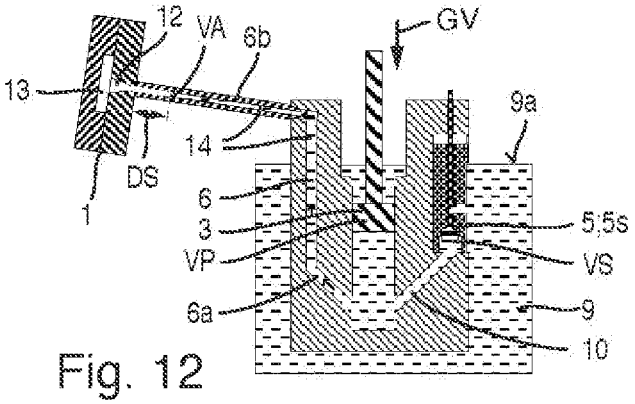
FIG. 12 shows the view from FIG. 3 during operation of the machine according to the method from FIG. 11 at the beginning of the initial pre-filling phase.

For this purpose, in an operating stage B2*a* of FIG. 11, this initial pre-filling phase thus starts by the casting piston 3 being advanced from the operating start position BS only as far as an initial pre-filling position VP shown in FIG. 12 after the shut-off control valve 5 has been closed and the mould 1 has been closed, FIG. 12 showing the machine during this operating stage B2*a*. As a result, the melt outlet channel 6 is pre-filled with the melt material 14 above the melt bath level 9*a* of the melt bath 9, preferably up to a pre-fill point VA in the front region of the melt outlet channel 6 or the mouthpiece body 6*b*, with the result that the pre-fill point VA is only at a relatively small distance DS from the exit of the melt outlet channel 6 into the mould 1 or from the gating cone 12. This distance DS may correspond approximately to the distance AS between the back-suction point RP and the exit of the melt outlet channel 6 into the mould 1, for example, as it is present after the above-explained back-suctioning of melt material 14 in the melt outlet channel 6 in the operation variant of FIG. 2 and as shown in FIG. 9. As an alternative, the distance DS may also differ slightly or considerably from the distance AS.

After this, in an operating stage B2*b* of FIG. 11, a certain, predefinable time period is waited for, until an excess pressure which has formed as a result of the pre-filling process on account of the compressed air in the mould cavity 13 has degraded. Then, in an operating stage B2*c* of FIG. 11, the shut-off control valve 5 is reversed from its closed position VS into its open position OS, and the casting piston 3 is moved back from the pre-filling position VP to its casting start position GS. As a result, melt material is sucked or refilled from the melt bath 9 via the melt inlet channel 4 into the casting chamber 2, as illustrated by an associated flow arrow in FIG. 13, which shows the machine at the end of this operating stage B2*c*, at which the casting piston 3 has reached its casting start position GS again.

Figure 13:
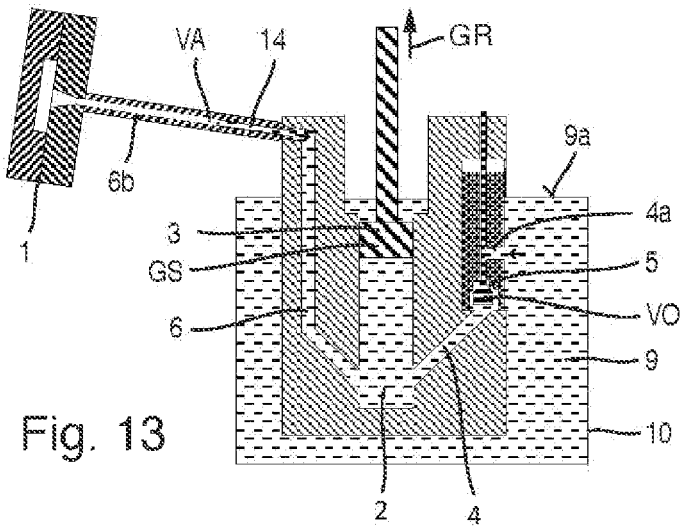
FIG. 13 shows the view from FIG. 12 at a later point in time of the initial pre-filling phase with refilling of the casting chamber with the melt.

This melt refilling process may be accompanied by a certain further back-suctioning of melt material 14 in the melt outlet channel 6, since a certain amount of air is also present in the closed mould 1 and the mould 1 is possibly also not completely airtight. As a result, the pre-fill point VA, up to which the melt material 14 was present in pre-fill in the melt outlet channel 6, can accordingly be displaced somewhat to the rear, as illustrated in FIG. 13 by an associated backflow arrow in the melt outlet channel 6 and a pre-fill point VA located further to the rear in the mouthpiece body 6*b* in comparison with FIG. 12. Nevertheless, the melt material 14 remains pre-filled in the melt outlet channel 6 significantly above the melt bath level 9*a* of the melt bath 9 as far as the front region of said melt outlet channel.

In principle, an analogous pre-filling process is also possible for the machine variant with the non-return valve $\mathbf{5}_R$ as shut-off valve 5. In this case, the non-return valve $\mathbf{5}_R$ remains closed by virtue of the melt pressure in the casting chamber 2, while the casting piston 3 is advanced from its operating start position BS to its pre-filling position VP. When provision is subsequently made for a suitable degradation of the excess pressure in operating stage B2*b*, as mentioned above, and then provision is made for a back-suctioning of melt material in the melt outlet channel 6 to be sufficiently hindered or slowed down, e.g. by virtue of an activatable closure in the melt outlet channel 6 and/or by virtue of a sufficiently fast return movement of the casting piston 3, the return movement of the casting piston 3 from the pre-filling position VP to its casting start position GS may create a negative pressure in the casting chamber 2 that is sufficient to open the non-return valve $\mathbf{5}_R$, such that in this case, too, melt material can be sucked in or refilled from the melt bath 9 via the melt inlet channel 4 into the casting chamber 2.

After this initial pre-filling phase has ended, the mould-filling phase of the first casting cycle is carried out according to an operating stage B2*d* of FIG. 11. For this purpose, the shut-off control valve 5*s* is reversed into its closed position VS again, or the non-return valve 5R closes automatically again after the melt negative pressure in the casting chamber 2 falls away, and the casting piston 3 is advanced out of its casting start position GS to the filling end position FP, with the result that again the melt material 14 is pressed from the casting chamber 2 via the melt outlet channel 6 into the casting mould 1, specifically the mould cavity 13.

Compared with the first casting cycle without pre-filling, as in the operation variant illustrated in FIG. 2, the initial pre-filling results in a shortening of the stroke distance HA=FP-BS between the filling end position FP and the operating start position BS already for this mould-filling phase of the first casting cycle. This shortening of the stroke for the first casting cycle is achieved analogously to the above-explained shortening of the stroke, which in the operation variant of FIG. 2 is achieved only for the further casting cycles by the premature closing of the shut-off control valve 5*s* in the refilling phase of the preceding casting cycle before the casting start position GS is reached and before the further return movement of the casting piston 3 to the casting start position GS. FIG. 14 shows the machine in this operating stage B2*d* at the end of the mould-filling phase of the first casting cycle with the shortening of the filling end position FP to a position $FP_{1V}$ for the variant with initial pre-filling that is located behind the filling end position $FP_1$ in the first casting cycle for the operation variant from FIG. 2 without pre-filling by a stroke deviation $HD_1=FP_1-FP_{1V}$. In other words, in this operation variant, as a result of this pre-filling measure there is a shortened casting stroke for carrying out the mould-filling operation already for the first casting cycle in comparison with the operation variant of FIG. 2 without pre-filling.

Consequently, in the operation variant of FIG. 11, the properties and advantages mentioned above in relation to the shortening of the stroke in the second casting cycle and in further casting cycles in the operation variant of FIG. 2 are achieved already for the first casting cycle by the operation variant of FIG. 11.

The further progression of the first casting cycle may correspond to that of the operation variant of FIG. 2 apart from the operating stage B3 there. As an alternative, the first casting cycle in the operation variant of FIG. 11 may be continued according to any desired conventional operating method.

FIG. 15 illustrates an advantageous variant of the operating method of FIG. 2 in terms of the performance of the second casting cycle and the further casting cycles. In this method variant, the respective mould-filling phase from the second casting cycle contains a pre-filling stage. In this respect, the operating situation at the end of the operating stage B7 is proceeded from, as illustrated in FIG. 9. In contrast to the operation variant according to the operating stage B8 of FIG. 2, in the operation variant from FIG. 15 in an operating stage B8*a* with the advancement of the casting piston 3, the complete closure of the mould 1 is not waited for, but rather the casting piston 3 is advanced out of the casting start position GS to a pre-filling position $VP_2$ for the second casting cycle already while the mould 1 is still open, this pre-filling position $VP_2$ also being referred to as cyclic pre-filling position $VP_2$ in the present case to distinguish the pre-filling position VP at the end of the initial pre-filling phase before the first casting cycle according to the operation variant of FIG. 11 and the illustration in FIG. 12.

This cyclic pre-filling measure makes it possible for the melt material 14 which has been previously back-suctioned away from the exit of the melt outlet channel 6 according to the operating stages B5 to B7 of the operation variant of FIG. 2 to be advanced again in the direction of the exit of the melt outlet channel 6 and as a result to pre-fill the melt outlet channel 6 to a greater extent, the air at the front end region of the melt outlet channel 6 being able to escape unhindered via the not-yet-closed mould 1.

In an operating stage B8*b* of FIG. 15, the casting piston 3 is then held in this cyclic pre-filling position until the mould 1 has completely closed. Subsequently, the remaining sequence of the mould-filling phase of the associated second or further casting cycle is carried out according to an operating stage B8*c* of FIG. 15, for which purpose the casting piston 3 is advanced from its cyclic pre-filling position to the filling end position FP and FP2, respectively, in order to press the melt material 14 from the chamber 2 via the pre-filled melt outlet channel 6 into the closed mould 1 or the mould cavity 13 thereof. The operating state of the machine corresponds at this point in time to that of FIG. 10 or to the end of the operating stage B8 of FIG. 2. In other words, in the operation variant of FIG. 15, after the mould-filling phase has ended, at the end of the operating stage B8*c* a continuation is made with the refilling phase and the further steps starting from the operating stage B3 of FIG. 2.

The cyclic pre-filling at the beginning of the mould-filling phase of the second casting cycle and the further casting cycles makes it possible for the cycle time and the air fraction in the cast part produced to be additionally reduced by a corresponding amount. In a correspondingly optimized procedure, the operation variants of FIGS. 2, 11 and 15 can be combined to the effect that, for a respective operation interval of the die-casting machine, at the start of operation first of all the initial pre-filling is carried out with the refilling of the casting chamber with melt according to the variant of FIG. 11, then the rest of the first casting cycle is carried out according to the operation variant of FIG. 2, and then the second casting cycle and the further casting cycles are carried out according to the operation variant of FIG. 15. As an alternative, operation variants according to the invention are possible, of these variants mentioned said operation variants using only the specific initial pre-filling operation and melt refilling operation after the start of operation according to FIG. 11 or only the back-suctioning measure according to the operating stages B3 to B8 of FIG. 2 with or without additional combination with the cyclic pre-filling according to FIG. 15.

The die-casting machine according to the invention is, as shown, configured for carrying out the operating method according to the invention. In particular, in this respect, the control unit 7 is correspondingly configured to carry out a respective casting process, for which purpose it controls the casting piston 3 in the casting chamber 2 to advance from the casting start position GS to the filling end position FP in the mould-filling phase, in order to press the melt material 14 into the casting mould 1 via the melt outlet channel 6, and to this end, in the example of FIGS. 1, 3 to 10 and 12 to 14, controls the shut-off control valve $\mathbf{5}_S$ directly or by way of the valve actuator 16 into its closed position VS, while in the machine configuration according to FIG. 16 the non-return valve $\mathbf{5}_R$ remains automatically in its closed position VS under the action of the preloading unit 17 and the melt pressure in the casting chamber 2. The control unit 7 is also configured to control the casting piston 3 to move back to the casting start position GS during the subsequent refilling phase, in order to supply the melt material 14 to the casting chamber 2 via the melt inlet channel 4, and, for this purpose, in the machine configuration of FIGS. 1, 3 to 10 and 12 to 14, firstly to control the shut-off control valve $\mathbf{5}_S$ into its open position VO, while in the machine configuration according to FIG. 16, the non-return valve $\mathbf{5}_R$ enters its open position VO by virtue of the negative pressure in the casting chamber 2.

The control unit 7 and the shut-off valve 5 may also be configured to switch over the shut-off valve 5 into its closed position VS again, still in the refilling phase, before the casting piston 3 has reached its casting start position GS by virtue of its return movement, and to control the casting piston 3 in a return movement again to back-suction melt material 14 in the melt outlet channel 6. As an alternative or in addition, the control unit 7 may also be configured, at a start-of-operation casting process, i.e. a first casting cycle, to control the casting piston 3 to advance in the casting chamber 2 from the operating start position BS to the pre-filling position VP during the pre-filling phase of the start-of-operation casting process before the mould-filling phase when the shut-off valve 5 is closed, provision subsequently being made for the shut-off valve 5 to enter its open position VO and for the casting piston 3 to be controlled to move back to its casting start position GS.

As in the examples shown, the die-casting machine optionally has a valve sensor unit 18 for sensing one or more measured variables of the shut-off valve 5. The measured values with respect to the respective measured variable that are detected by the valve sensor unit 18 may be supplied to the control unit 7 as required, in order to provide it with control feedback about the current position of the shut-off valve 5. In addition or as an alternative, the measured values may be used for a diagnosis evaluation, in order to diagnose the current state of the shut-off valve 5, e.g. in terms of any malfunctions, and to identify when the shut-off valve 5 needs maintenance.

Depending on requirements and the usage situation, the valve sensor unit 18 may comprise one or more sensors, including optional limit switches with or without a link to the control unit 7, which as already mentioned may be an entire machine control system of the die-casting machine or part of this machine control system. The valve sensor unit 18 may be configured to measure the stroke of the shut-off valve, for example, in order to derive an error diagnosis therefrom, e.g. whether the valve closing body 5*c* is torn off and the valve rod 5*d* overruns its intended position during the valve closing movement and/or whether the valve closing body 5*c* actually reaches its closed position or comes to a stop prematurely. The valve sensor unit 18 may optionally also comprise a force sensor in the valve rod 5*d* that measures the closing force or the contact pressure and/or the opening force of the valve closing body 5*c* for the purpose of diagnosis monitoring. In the case of an electrical or hydraulic and/or pneumatic valve drive e.g. by way of the valve actuator 16, for this monitoring purpose the valve sensor unit 18 may also comprise a flow sensor or pressure sensor of conventional design, whether it has a link to the control unit 7 or not.

As is made clear by the exemplary embodiments shown and the further exemplary embodiments explained above, the invention provides an advantageous method for operating a die-casting machine which makes it possible to achieve short casting cycle times, a lower air fraction in the cast part, a low tendency to wear of casting piston and casting chamber by virtue of a reduced casting piston stroke, and/or avoidance of the formation of a melt droplet in the gating cone region. The invention also provides a die-casting machine suitable for carrying out this operating method, which die-casting machine may be in particular of the hot-chamber type.

What is claimed is:

1. A method for operating a die-casting machine which has a casting mould, a casting chamber, a casting piston arranged in an axially movable manner in the casting chamber, a melt inlet channel which leads into the casting chamber, a shut-off valve in the melt inlet channel, and a melt outlet channel which leads from the casting chamber to the casting mould, the method comprising:

for carrying out a respective casting process, in a mould-filling phase, with the shut-off valve closed, the casting piston in the casting chamber is advanced from a casting start position to a filling end position and, as a result, melt material is pressed into the casting mould via the melt outlet channel and, in a subsequent refilling phase, the casting piston is moved back to the casting start position and, as a result, with the shut-off valve open, the casting chamber is supplied with melt material via the melt inlet channel, wherein, in the refilling phase of the casting process, the previously open shut-off valve is closed before the casting piston has reached a casting start position of the casting piston by virtue of a return movement, and as a result of the further return movement of the casting piston melt material in the melt outlet channel is back-suctioned.

2. The method according to claim 1, wherein in the refilling phase, the casting piston is moved back in the period of time when the shut-off valve is closed at a lower speed than in the preceding period of time when the shut-off valve is still open.

3. The method according to claim 1, wherein in the refilling phase of the casting process, the previously open shut-off valve is closed as soon as the casting piston has reached a valve switchover position by virtue of the return movement.

4. The method according to claim 3, wherein a stroke distance between the valve switchover position of the casting piston and the casting start position is variably predefinable.

5. The method according to claim 3, wherein in the refilling phase of the casting process, the casting piston is held in the valve switchover position during a halt period before being moved back again to the casting start position.

6. The method according to claim 1, wherein, in the refilling phase of the casting process, the casting mould is kept closed at least for as long as the shut-off valve is still open.

7. The method according to claim 1, wherein, in the refilling phase of the casting process, opening of the casting mould is commenced after the casting piston has reached the casting start position.

8. The method according to claim 1, wherein, in the refilling phase of the casting process, opening of the casting mould is commenced after the casting piston has reached a valve switchover position of the casting piston and before having reached the casting start position.

9. The method according to claim 8, wherein, in the refilling phase of the casting process, the casting piston is stopped in the valve switchover position and is advanced from the valve switchover position into the casting start position as soon as the casting mould has reached a given casting-piston-triggering mould opening position when it is opened.

10. The method according to claim 1, wherein the casting piston is advanced from the casting start position, reached during the refilling phase of a respectively previous casting process, to a pre-filling position during an initial pre-filling stage of the mould-filling phase of a subsequent casting process with the casting mould being not yet completely closed, and only thereafter is the casting mould completely closed and the casting piston advanced to the filling end position.

11. A method for operating a die-casting machine which has a casting mould, a casting chamber, a casting piston arranged in an axially movable manner in the casting chamber, a melt inlet channel which leads into the casting chamber, a shut-off valve in the melt inlet channel, and a melt outlet channel which leads from the casting chamber to the casting mould, the method comprising:

for carrying out a respective casting process, in a mould-filling phase, with the shut-off valve closed, the casting piston in the casting chamber is advanced from a casting start position to a filling end position, and as a result melt material is pressed into the casting mould via the melt outlet channel and, in a subsequent refilling phase, the casting piston is moved back to the casting start position and, as a result, with the shut-off valve open, the casting chamber is supplied with melt material via the melt inlet channel, wherein during a start-of-operation casting process in a pre-filling phase of the start-of-operation casting process before the mould-filling phase, with the shut-off valve closed, the casting piston in the casting chamber is advanced from a start-of-operation position to a pre-filling position, and then the shut-off valve is opened and the casting piston is moved back to the casting start position.

* * * * *